US008907652B2

(12) United States Patent
Lecce et al.

(10) Patent No.: US 8,907,652 B2
(45) Date of Patent: Dec. 9, 2014

(54) BAND-GAP VOLTAGE GENERATOR

(75) Inventors: Sergio Lecce, Pavia PV (IT); Maurizio Rossi, Nerviano MI (IT)

(73) Assignee: STMicroelectronics S.R.L., Agrate Brianza (MB) (IT)

( * ) Notice: Subject to any disclaimer, the term of this patent is extended or adjusted under 35 U.S.C. 154(b) by 238 days.

(21) Appl. No.: 13/438,991

(22) Filed: Apr. 4, 2012

(65) Prior Publication Data

US 2012/0256605 A1 Oct. 11, 2012

(30) Foreign Application Priority Data

Apr. 8, 2011 (IT) ..... MI2011A0584

(51) Int. Cl.
*G05F 3/16* (2006.01)
*G05F 3/30* (2006.01)

(52) U.S. Cl.
CPC ..... *G05F 3/30* (2013.01)
USPC ..... 323/313; 323/314; 327/539

(58) Field of Classification Search
USPC ..... 323/311–317; 330/252, 256, 257, 261, 330/266, 271, 272; 327/538–540
See application file for complete search history.

(56) References Cited

U.S. PATENT DOCUMENTS

| | | | | |
|---|---|---|---|---|
| 5,432,432 | A | 7/1995 | Kimura | |
| 5,481,218 | A | 1/1996 | Nordholt et al. | |
| 5,703,477 | A * | 12/1997 | Punzenberger | 323/313 |
| 6,157,245 | A | 12/2000 | Ricon-Mora | |
| 6,294,902 | B1 | 9/2001 | Moreland et al. | |
| 7,834,695 | B2 * | 11/2010 | Esch | 330/257 |
| 7,948,297 | B1 * | 5/2011 | Cosand | 327/513 |
| 2007/0252573 | A1 | 11/2007 | Tachibana et al. | |

* cited by examiner

*Primary Examiner* — Nguyen Tran
(74) *Attorney, Agent, or Firm* — Allen, Dyer, Doppelt, Milbrath & Gilchrist, P.A.

(57) ABSTRACT

A generator of a voltage logarithmically variable with temperature may include a differential amplifier having a pair of transistors, each coupled with a respective bias network adapted to bias in a conduction state the transistors first and second respectively with a constant current and with a current proportional to the working absolute temperature. The pair of transistors may generate between their control nodes the voltage logarithmically variable with temperature. The differential amplifier may have a common bias current generator coupled between the common terminal of the differential pair of transistors and a node at a reference potential, and a feedback line to provide a path for the current difference between the sum of currents flowing through the transistors of the differential pair and the common bias current.

13 Claims, 6 Drawing Sheets

BAND-GAP VOLTAGE GENERATOR

FIELD OF THE INVENTION

The present disclosure relates to reference voltage generators and, more particularly, to a generator of a voltage variable with temperature to a bandgap voltage generator and to a related method of generating a temperature compensated bandgap voltage.

BACKGROUND OF THE INVENTION

Most electronic circuits may require a stable direct current (DC) voltage reference, particularly with regard to fluctuations of working temperature for the circuits. Usually, such stable voltage reference circuits are bandgap voltage generators that are based upon the property of a bipolar transistor to produce a base-emitter voltage with well known temperature dependence.

According to a theoretical analysis in the article: Yannys P. Tsividis, "Accurate analysis of temperature effects in $I_C$-$V_{BE}$ characteristics with application to bandgap reference sources", IEEE Journal of solid-state circuits, Vol. SC-15, No. 6, December 1980, pages 1076-1084, the following equation holds:

$$V_{BE}(T) = V_{BG0} - (V_{BG0} - V_{BE}(T_{REF}))\cdot\frac{T}{T_{REF}} - \alpha\cdot V_T\cdot\ln(T/T_{REF}) \quad (1)$$

where $V_{BE}$ is the base-emitter voltage, $V_{BG0}$ is the bandgap voltage expected at a null temperature, $T_{REF}$ is a reference temperature, $\alpha$ is a coefficient, and $V_T$ is the voltage equivalent of temperature. The following equation holds for $V_T$:

$$V_T = \frac{kT}{q}$$

Neglecting the (generally) small term $\alpha\cdot V_T\cdot\ln(T/T_{REF})$, $V_{BE}$ voltage is complementary to the absolute temperature (CTAT). In literature, two main classes of bandgap generators are disclosed:

1. First Order Bandgap: this is the oldest type of voltage reference. Its architecture used since 1960's. It typically has a temperature coefficient TC=50 ppm/° C. and an absolute value spread of 12 mV, in a 190° C. temperature range.
2. Second Order Bandgap: this type has been used for the last 10-15 years. It has a typical temperature coefficient TC=15 ppm/° C. and absolute value spread of 3 mV, in a 190° C. temperature range.

In known bandgap voltage reference generators, for example, the generator disclosed in U.S. Pat. No. 4,249,122 to Widlar, a pair of transistors are operated at different current densities and are coupled to generate a voltage that is proportional to the difference between the base-emitter voltages of the two transistors. This difference voltage has a positive temperature coefficient, i.e. the difference voltage is proportional to the absolute temperature (PTAT) of the circuit. The PTAT voltage provided by the difference in the base-emitter voltages is properly scaled and summed with the complementary to absolute temperature voltage of one of the transistors to generate a stable bandgap voltage reference.

In first-order bandgap compensation, the first derivative of the base-emitter voltage with respect to temperature is nullified in correspondence to a reference temperature $T_{REF}$, as shown in FIG. 1, thus the generated bandgap voltage varies with the working absolute temperature T, assuming a typical peak value of 1.22V with a typical maximum fluctuation of about 12 mV. The term $\alpha\cdot V_T\cdot\ln(T/T_{REF})$ is the cause of the residual temperature dependency after a first-order compensation.

In widely diffused second order bandgap voltage generators, a voltage proportional to the square absolute temperature (PSTAT) is used to compensate the second order term of the Taylor expansion of a $\alpha\cdot V_T\cdot\ln(T/T_{REF})$, such to nullify at the reference temperature $T_{REF}$ the first derivative and the second derivative of the output voltage $V_{OUT}$ with respect to the absolute temperature, obtaining a voltage-temperature characteristic as shown by way of example in FIG. 2.

In other second order bandgap voltage generators, a non-linear current is generated. This current is proportional to T*ln(T/Tref) and it is added to compensate for the term $\alpha\cdot V_T\cdot\ln(T/T_{REF})$. An exemplary architecture implementing such a second order bandgap compensation is shown in FIG. 3a and is disclosed in the article by Guang Ge, Cheng Zhang, Gian Hoogzaad, Kofi Makinwa, "A single-trim CMOS bandgap reference with a 3σ inaccuracy of ±0.15% from −40° C. to 125° C.," 2010 IEEE International Solid-State Circuits Conference, session 4, analog techniques, 4.3, pages 78-80. The current is generated by the difference of two bipolar's $V_{be}$: one of them is biased with a PTAT current, while the other transistor is biased with a current constant versus temperature. An exemplary variation of the output voltage with temperature for the circuit of FIG. 3a is shown in FIG. 3b. Typically, voltage fluctuations with temperature are relatively reduced. Other architectures that include a second order bandgap compensation are disclosed in U.S. Pat. Nos. 6,828,847, 7,598,799, 7,514,987, and 7,583,135.

Even if voltage fluctuations with temperature are limited in a smaller range than that of first-order bandgap voltage generators, these architectures may be complicated to realize and/or cannot accurately and independently adjust the PTAT and logarithmic terms. In other words, the generated bandgap voltage, after the trimming procedure, may vary greatly in temperature ranges from −40° C. up to 150° C.

SUMMARY OF THE INVENTION

According to a method for having a stable bandgap voltage, it may be necessary to realize a generator of a voltage that varies logarithmically with the working absolute temperature, exactly as the logarithmic addend in equation (1), then to add such a logarithmically varying voltage with a first-order bandgap voltage.

Studies carried out show that it is possible to realize a generator of a voltage that varies logarithmically with temperature using a simple architecture, based on a typical differential amplifier, that may be used at the same time also as an adder.

More precisely, according to this disclosure, a generator of a voltage logarithmically variable with temperature may comprise a differential amplifier comprising a pair of transistors (Q1, Q2), i.e. first (Q1) and second (Q2), each coupled with a respective bias network adapted to bias in a conduction state the transistors first (Q1) and second (Q2) respectively with a constant current and with a current proportional to the working absolute temperature. The pair of transistors (Q1, Q2) may be adapted to generate between its control nodes the voltage logarithmically variable with temperature, a common bias current generator ($I_{BIAS}$) coupled between the common terminal of the differential pair of transistors (Q1, Q2) and a node at a reference potential, and a feedback line adapted to constitute a free-wheeling path for the current difference between the common bias current ($I_{BIAS}$) and the sum of the currents flowing through the transistors of the differential pair (Q1, Q2).

This architecture may be used as the input stage of an operational amplifier, or as an operational amplifier, for adding the logarithmically variable voltage with a first-order bandgap voltage, without requiring further active components. This approach may allow for independently and accurately adjusting, by trimming procedures, the PTAT and logarithmic terms, in order to get the maximum achievable accuracy.

The disclosed generator of a voltage logarithmically variable with temperature may be used for realizing a bandgap voltage generator. A particularly effective trimming sequence of the herein proposed voltage generator is disclosed.

DETAILED DESCRIPTION OF THE PREFERRED EMBODIMENTS

Figure 1:
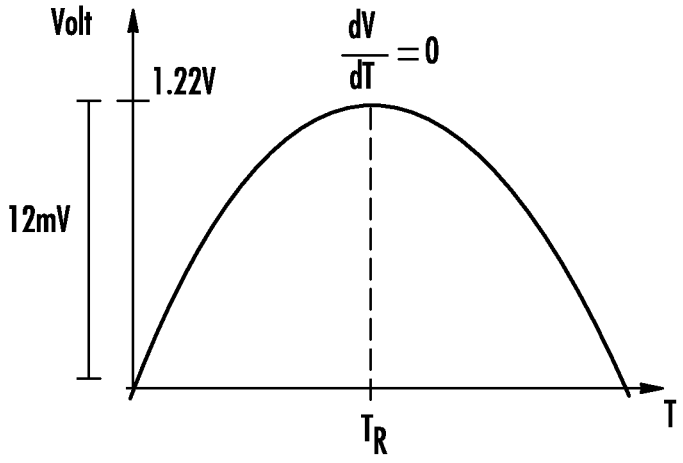
FIG. 1 PRIOR ART
FIG. 1 depicts an exemplary voltage-temperature characteristic of a first-order bandgap voltage generator, according to the prior art.
Figure 2:
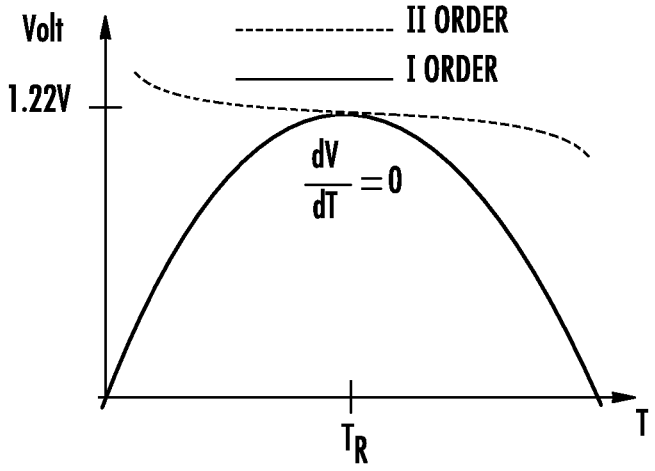
FIG. 2 PRIOR ART
FIG. 2 is a diagram comparing exemplary voltage-temperature characteristics of a first-order bandgap voltage generator and of a second-order bandgap voltage generator, according to the prior art.
Figure 3:
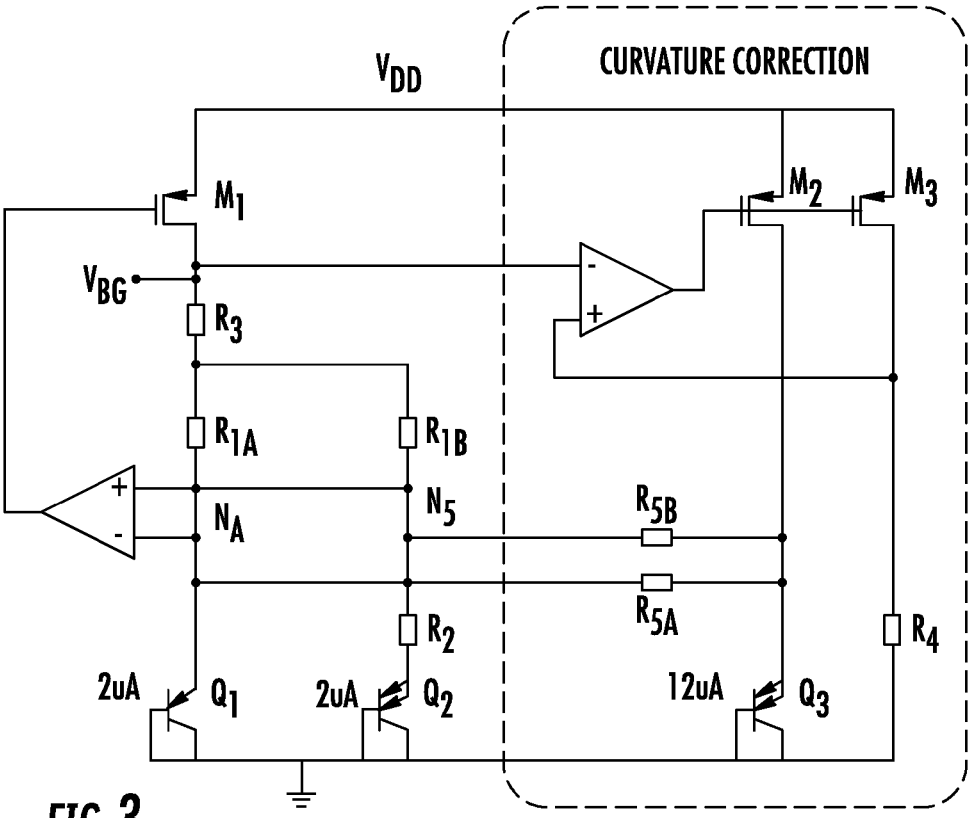
FIG. 3 PRIOR ART
FIG. 3 depicts a second-order bandgap voltage generator, according to the prior art.
Figure 4:
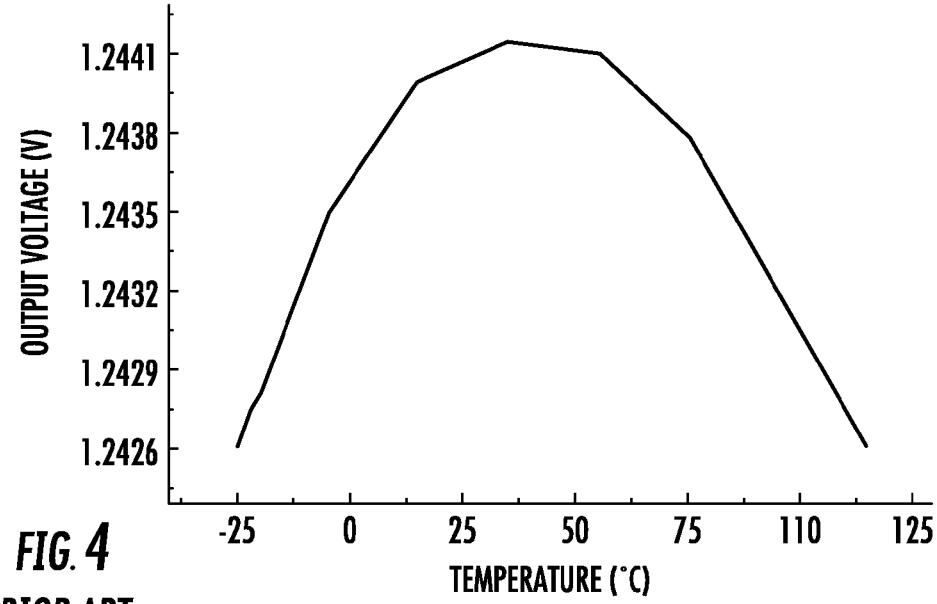
FIG. 4 PRIOR ART
FIG. 4 is a typical voltage-temperature characteristic of the generator of FIG. 3.
Figure 5A:
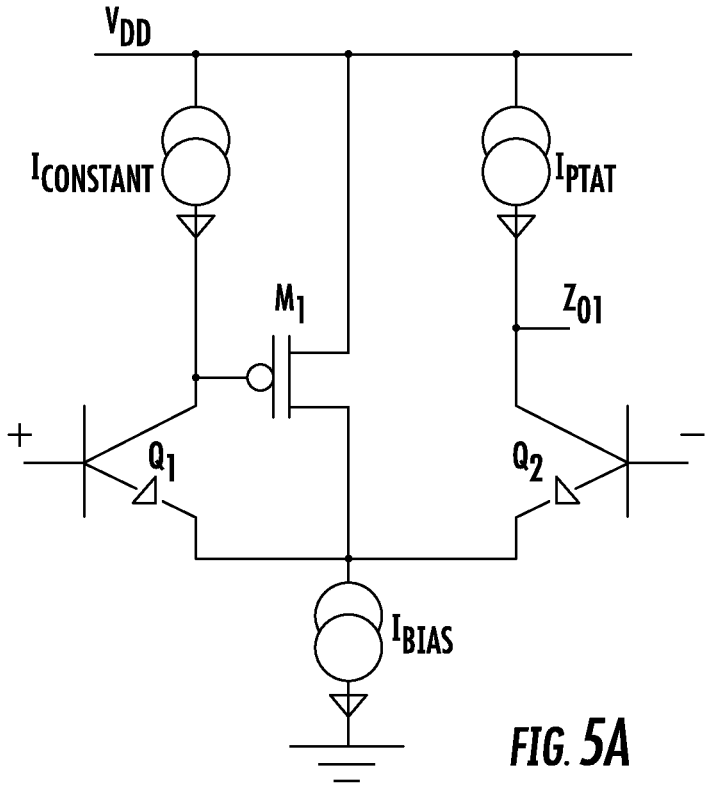
FIG. 5*a* depicts a generator of a voltage logarithmically variable with temperature, according to the present invention.

The term that compensates for the logarithmic addend in equation (1) is generated with a logarithmic voltage generator, an embodiment of which is shown in FIG. 5*a*. It essentially comprises a differential pair of transistors Q1 and Q2, which are generating the voltage logarithmically varying with temperature between the control nodes thereof. One transistor Q1 is biased with a current constant with temperature $I_{constant}$, and the other transistor Q2 is biased with a current proportional to the absolute temperature $I_{PTAT}$. As may be shown hereinafter, the current $I_{PTAT}$ is generated in common first-order bandgap voltage generators.

The currents $I_{constant}$ and $I_{PTAT}$, together with the bias current generator $I_{BIAS}$, force the two transistors Q1 and Q2 of the differential pair into a conduction state. The feedback line, that in the shown example is a MOS controlled in a conduction state by the voltage on the current terminal of Q1 not in common with the transistor Q2, provides a free-wheeling path to the currents entering in the common node of the two transistors Q1 and Q2.

The transistors Q1 and Q2 are matched, thus the voltage difference between their control terminals is proportional to the product of the voltage equivalent of temperature by the natural logarithm of the ratio of the collector currents flowing therethrough. Therefore, the architecture of FIG. 5*a* generates a voltage that has the desired law of variation with the working absolute temperature for compensating for the logarithmic addend in equation (1).

It is thus possible to realize a bandgap voltage generator of a voltage substantially independent from temperature in a broad range of temperature variation by adding the voltage generated by any first-order bandgap generator with an adjusted replica of the logarithmically varying voltage available between the control nodes of the differential pair of transistors.

Figure 5B:
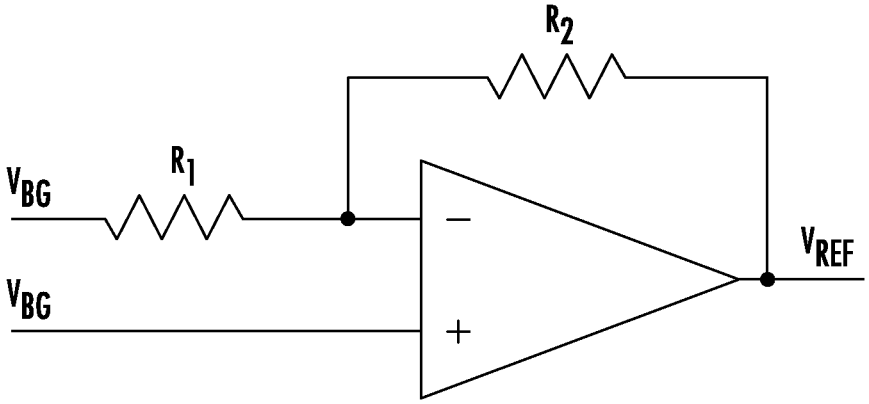
FIG. 5*b* is an operational amplifier comprising the generator of FIG. 5*a* configured for adding a first-order bandgap voltage with the voltage logarithmically variable with temperature.

According to an aspect of this disclosure, an adder adapted for performing this sum may be realized using the same differential pair of transistors as an operational amplifier or as the input stage of an operational amplifier, as depicted in FIG. 5*b*. The operational amplifier receives on an input terminal a bandgap voltage $V_{BG}$ generated by a first-order bandgap voltage generator, and has a resistive voltage divider coupled between an output node of the operational amplifier and a first input node thereof, a middle node of the resistive voltage divider being shorted to the other input node of the operational amplifier.

Of course, it is possible to connect the resistive voltage divider between the output and the non-inverting input of the operational amplifier and to connect the middle node of the voltage divider to the inverting input. The voltage generated by the operational amplifier $V_{ref}$ is the sum of the voltage applied on the first input node of the operational amplifier and an amplified replica of the voltage difference between the two input nodes of the operational amplifier. Therefore, if the input nodes of the operational amplifier of FIG. 5*b* coincide with the control nodes of the differential pair of transistors Q1 and Q2 depicted in FIG. 5*a*, the voltage $V_{BG}$ applied to the first input node of the operational amplifier is added to the amplified replica of the voltage logarithmically varying with temperature generated by the logarithmic voltage generator.

Figure 6:
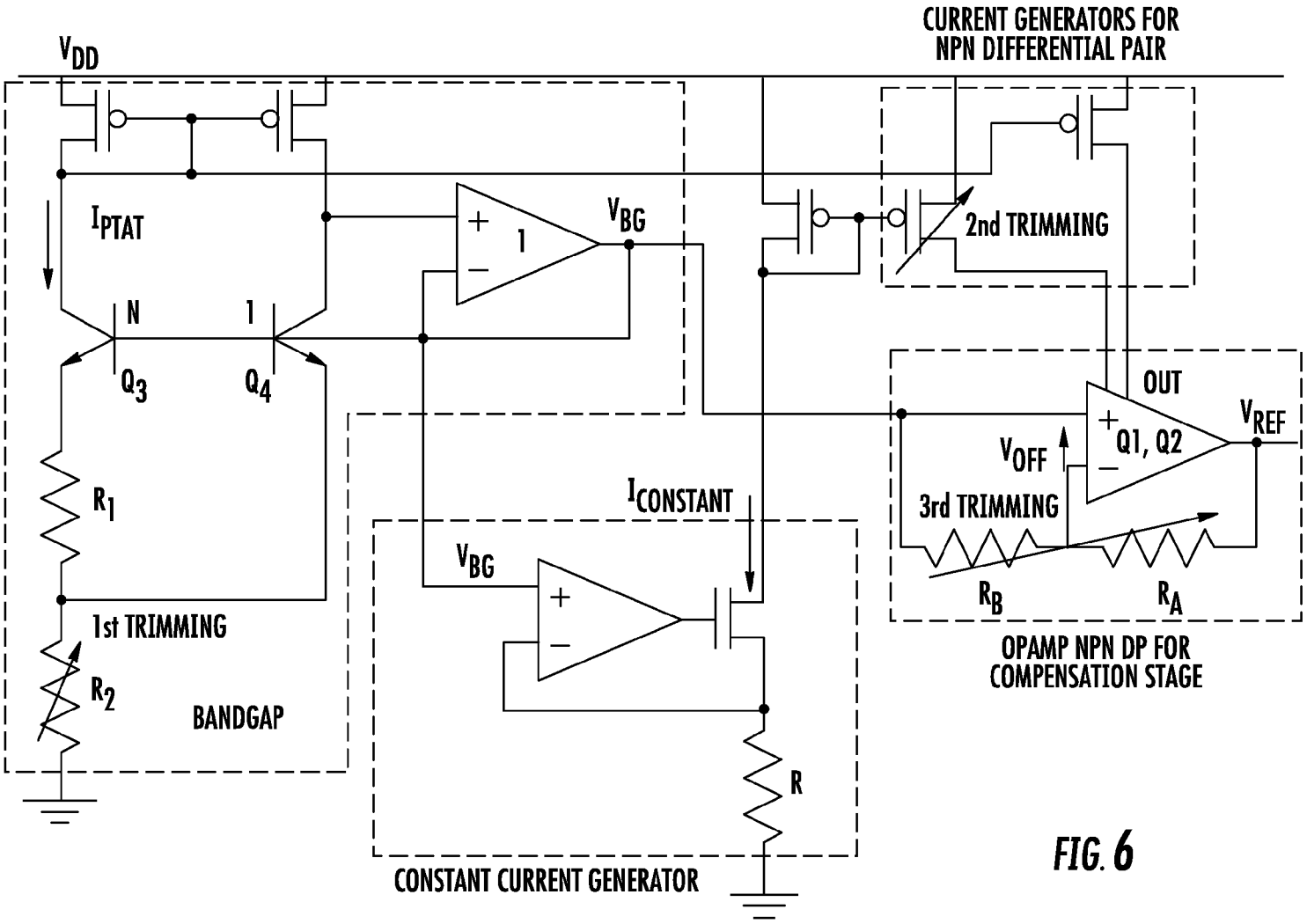
FIG. 6 is an exemplary embodiment of a logarithmically compensated bandgap voltage generator in which the resistors subjected to trimming steps are highlighted, according to the present invention.

A circuit scheme of a logarithmically compensated bandgap voltage generator is shown in FIG. 6. On the left side, there is a common first-order bandgap voltage generator comprising a current mirror forcing a same current $I_{PTAT}$ through two paired transistors Q3 and Q4, one (Q3) having an aspect ratio N times larger than the other (Q4), and a resistor R1 on which a voltage difference $\Delta V_{BE}$ proportional to the absolute temperature is applied. The voltage generator serves as a voltage buffer of the generated bandgap voltage $V_{BG}$. This first order generator may be trimmed according to a standard procedure to adjust the PTAT term.

In the example of FIG. 6, the resistor R2 is trimmed, but it is possible to trim the resistor R1 instead and more generally to use a suitable trimming procedure of a first-order bandgap generator. The current $I_{PTAT}$ is mirrored to bias one of the transistors of the differential pair of transistors of FIG. 5*a* embedded in the operational amplifier that generates the voltage $V_{REF}$.

A constant current generator, that may realized for example using the bandgap voltage $V_{BG}$, generates a constant current $I_{CONSTANT}$ that is mirrored to bias the other transistor of the differential pair of transistors of FIG. 5*a*. The first-order bandgap voltage $V_{BG}$ is applied to an input of the differential amplifier OUT that generates the temperature compensated bandgap voltage $V_{REF}$, in the illustrated embodiment, shown in FIG. 6, is the non inverting input. By properly trimming the values of the resistors $R_A$ and $R_B$ of the voltage divider, it is possible to match the gain $G=1+R_A/R_B$ of this amplifier with the value $\alpha$ in equation (1).

The disclosed embodiment of FIG. 6 may be trimmed to compensate accurately for the temperature-dependent terms of equation (1) because the voltages $V_{BG}$ and $V_{REF}$ are provided with a small output impedance. Therefore, it is possible to sense them accurately during the trimming steps because the methods for sensing them may not significantly disturb the values that they assume during the normal functioning.

According to the disclosed procedure, the first-order bandgap generator (in the shown example, the resistor R2) is trimmed at a first temperature in order to make the voltage $V_{BG}$ equal to a target voltage $V_{BG0}$. In some embodiments, the first temperature is conveniently chosen in the middle of the operating temperature range.

Figure 7:
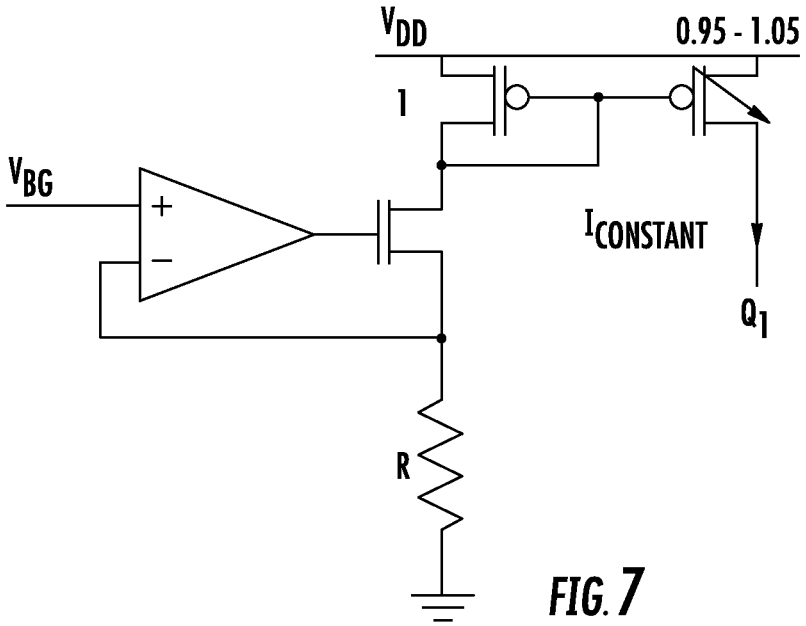
FIG. 7 shows the range of the mirror ratio to be fixed in the second trimming step, according to the present invention.

At the same temperature, a second trimming step may be performed. This second trimming step is aimed to adjust one of the two currents biasing the logarithmic voltage generator by adjusting the mirror ratio of the current mirror Q5, Q6. As shown in FIG. 7, with the second trimming step, the current $I_{CONSTANT}$ that biases the transistor Q1 of the logarithmic voltage generator is adjusted such to nullify the difference voltage $V_{REF}-V_{BG}$.

As an alternative, it is possible to execute the second trimming step for adjusting the current $I_{PTAT}$ instead of the current $I_{CONSTANT}$. At a second temperature, the ratio $R_A/R_B$ may be trimmed to obtain an output $V_{REF}$ voltage equal to the target $V_{BG0}$. This third trimming step allows for adjusting the logarithmic voltage contribution independently from PTAT voltage contribution. In some embodiments, the third trimming step may be conveniently chosen at one of the end values of the operating temperature range.

Differently from typical bandgap voltage generators, the disclosed architecture may have a reduced number of components and may be realized using any first-order bandgap voltage generator and any constant current generator. Conveniently, the constant current generator may be obtained using the same bandgap voltage made available by the first-order generator, though any constant current generator may be used.

Figure 8:
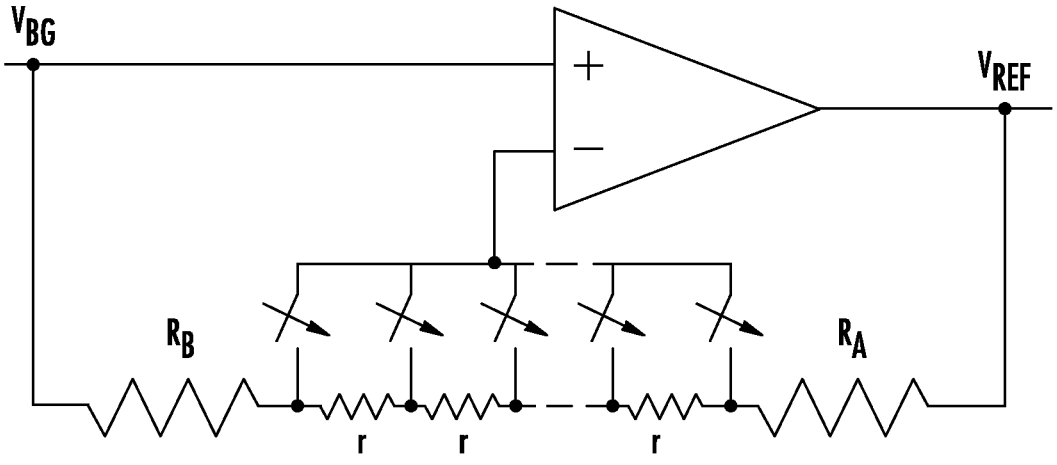
FIG. 8 shows how to trim the voltage divider $R_A$, $R_B$ of FIG. 6.
Figure 9:
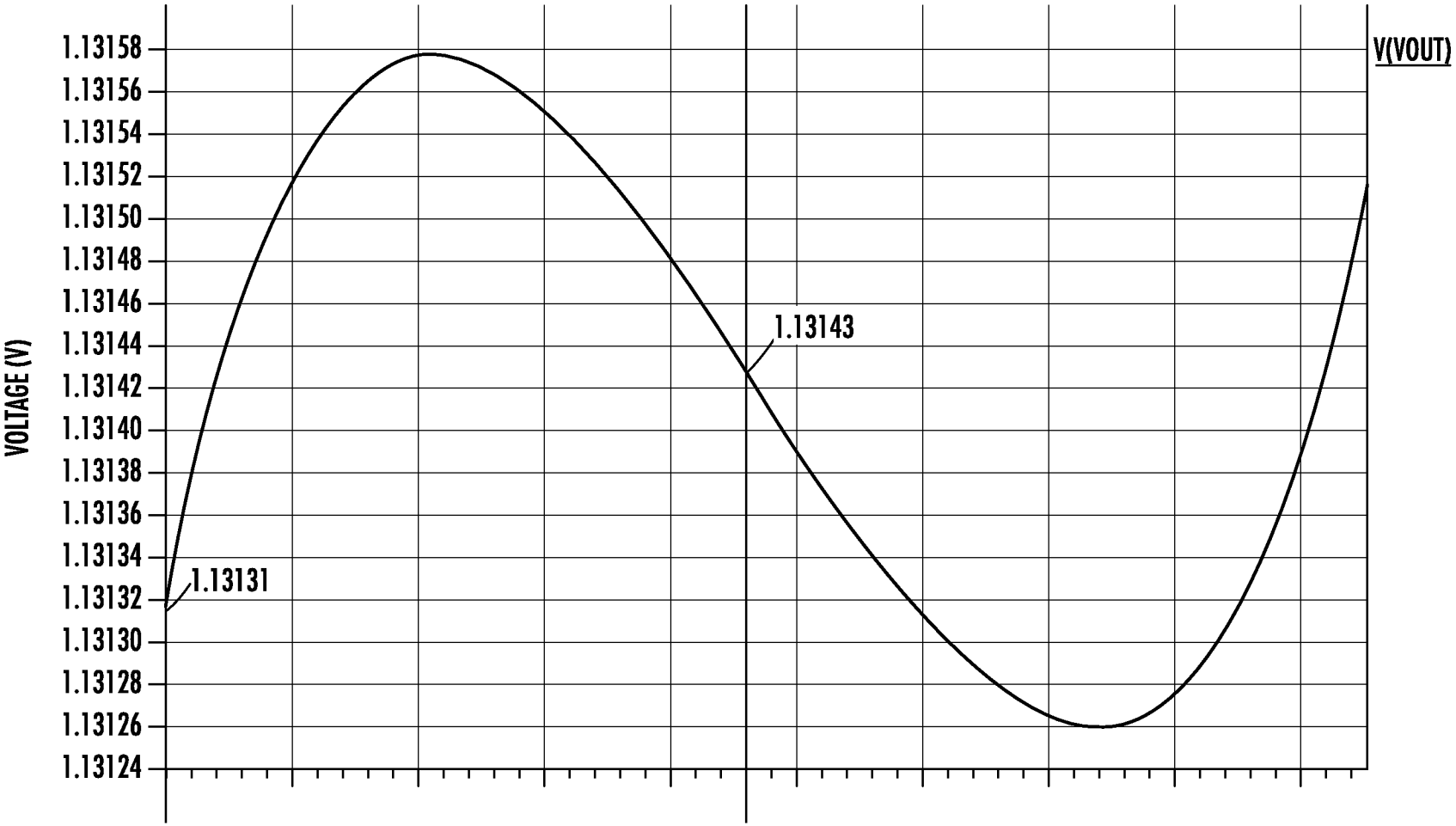
FIG. 9 is an exemplary voltage-temperature characteristic of the bandgap voltage generator of FIG. 6.

Optionally, the resistive voltage divider $R_A$, $R_B$ may be realized as a series of resistors of small value, as shown in FIG. 8, a middle point of which to be coupled to an input of the operational amplifier OUT being determined with a trimming step. At the reference temperature $T_{REF}$, at which the voltage difference between the control nodes of the differential pair of transistors Q1 and Q2 of FIG. 5*a* is null, the derivative of the first-order bandgap voltage $V_{BG}$ is not null, but has negative value. Since the derivative of the logarithmic voltage term is positive, by adding the two contributions, the voltage-temperature characteristic of the logarithmically compensated bandgap voltage generator oscillates around the reference voltage $V_{REF}$ at the reference temperature $T_{REF}$ and is contained in a relatively small interval over a very broad temperature range.

A simulation voltage-temperature characteristic of the bandgap voltage generator is depicted in FIG. 8. The generated output bandgap voltage is about 1.131V with a peak-to-peak variation of 320 μV over a very broad working temperature range from −40° C. up to 150° C., and thus with a mean temperature coefficient of 1.5 ppm/° C. The bandgap generator with logarithmic compensation stage allows for more accurate voltage reference, for products requiring a large operating temperature range. With the highly stable voltage reference, it is possible to design very accurate devices, such as voltage regulators, constant current generators, ADCs etc. It also does not need extra trimming structure, such as a LASER or other expensive tools or process steps. The three trimming procedures may be done with automatic test equipment (ATE) at two different temperatures. For best accuracy, the first and second trimming steps may be performed at $T=T_{ref}$, to have an output voltage equal to $V_{BG0}$ (and $V_{BG}=V_{REF}$), the last at a border of operating temperature range, to minimize the residual temperature dependence. For reduced accuracy applications, the last step can be skipped, using an expected typical $\alpha$ value obtained using technology device modeling. In that case, the performance achievable may be similar to the typical second order bandgap approaches. Possible modifications and/or additions may be made by those skilled in the art to the hereinabove disclosed and illustrated embodiment while remaining within the scope of the following claims.

That which is claimed is:

1. A voltage generator comprising:

first and second bias networks;

a differential amplifier comprising first and second transistors, each transistor being coupled respectively to said first and second bias networks and comprising a control terminal, said first and second transistors having a common terminal therebetween;

said first and second bias networks configured to respectively bias in a conduction state said first and second transistors respectively with a constant current and with a proportional to absolute temperature (PTAT) current;

said first and second transistors configured to generate between said control terminals a voltage logarithmically variable with temperature;

a common bias current generator coupled between the common terminal and a reference potential; and a feedback path configured to provide a path for a current difference between a sum of the constant current and the PTAT current, and a current of the common bias current generator, said feedback path comprising a third transistor coupled between said common terminal and a supply reference voltage, said first transistor comprising a conduction terminal configured to control said third transistor.

2. The voltage generator of claim 1 wherein said third transistor comprises a free-wheeling transistor.

3. A logarithmically compensated bandgap voltage generator comprising:

a first-order bandgap voltage generator configured to generate a first-order temperature compensated bandgap voltage and to deliver a proportional to absolute temperature (PTAT) current;

an amplifier having an output terminal configured to generate a logarithmically compensated bandgap voltage, a first input terminal configured to receive the first-order temperature compensated bandgap voltage, and a second input terminal, said amplifier comprising first and second bias networks, an input differential amplifier comprising first and second transistors, each transistor respectively coupled to said first and second bias networks and having a control terminal configured to provide first and second input terminals of said amplifier, said first and second transistors having a common terminal therebetween, said first and second bias networks configured to respectively bias in a conduction state said first and second transistors respectively with a constant current and with the PTAT current, said first and second transistors configured to generate between said control terminals a voltage logarithmically variable with temperature, a common bias current generator coupled between the common terminal and a reference potential, and a feedback path configured to provide a path for a current difference between a sum of the constant current and the PTAT current, and a current of the common bias current generator; and a resistive voltage divider coupled between the output terminal and the first input terminal of said amplifier, and having a middle node coupled to the second input terminal of said amplifier.

4. The logarithmically compensated bandgap voltage generator of claim 3 wherein said second transistor comprises a conduction terminal configured to provide the output terminal of said amplifier.

5. The logarithmically compensated bandgap voltage generator of claim 4 wherein said conduction terminal is not in common with said first transistor.

6. The logarithmically compensated bandgap voltage generator of claim 3 wherein said resistive voltage divider comprises a plurality of resistors coupled in series.

7. The logarithmically compensated bandgap voltage generator of claim 3 wherein said feedback path comprises a free-wheeling transistor coupled between said common terminal and a supply reference voltage; and wherein said first transistor comprises a conduction terminal configured to control said free-wheeling transistor.

8. A method of generating a logarithmically temperature compensated bandgap voltage using a voltage generator comprising first and second bias networks, a differential amplifier comprising first and second transistors, each transistor being respectively coupled to the first and second bias networks and comprising a control terminal, the first and second transistors having a common terminal therebetween, the first and second transistors generating between the control terminals a voltage logarithmically variable with temperature, a common bias current generator coupled between the common terminal and a reference potential, and a feedback path providing a path for a current difference between a sum of a constant current and a proportional to absolute temperature (PTAT) current, and a current of the common bias current generator, the method comprising:

biasing in a conduction state the first and second transistors respectively with the constant current and with the PTAT current; and generating the logarithmically temperature compensated bandgap voltage by adding an amplified replica of a voltage difference between the control terminals of the first and second transistors with a first-order temperature compensated bandgap voltage.

9. A method of trimming a logarithmically temperature compensated bandgap voltage generator comprising a first-order bandgap voltage generator generating a first-order temperature compensated bandgap voltage and delivering a proportional to absolute temperature (PTAT) current, an amplifier comprising an output terminal generating a logarithmically compensated bandgap voltage, a first input terminal configured to receive the first-order temperature compensated bandgap voltage, and a second input terminal, the amplifier comprising first and second bias networks, an input differential amplifier comprising first and second transistors, each transistor coupled respectively to the first and second bias networks and having a control terminal providing first and second input terminals of the amplifier, the first and second transistors having a common terminal therebetween, the first and second bias networks respectively biasing in a conduction state the first and second transistors respectively with a constant current and with the PTAT current, the first and second transistors generating between the control terminals a voltage logarithmically variable with temperature, a common bias current generator coupled between the common terminal and a reference potential, and a feedback path providing a path for a current difference between a sum of the constant current and the PTAT current, and a current of the common bias current generator, and a resistive voltage divider coupled between the output terminal and the first input terminal of the amplifier, and having a middle node coupled to a second input terminal of the amplifier, the method comprising:

trimming the first-order bandgap voltage generator to generate, at a first temperature, the first-order temperature compensated bandgap voltage equal to a design voltage;

trimming the first and second bias networks to generate, at the first temperature, the constant current and the PTAT current to reduce a difference between the logarithmically temperature compensated bandgap voltage and the first-order temperature compensated bandgap voltage; and trimming the resistive voltage divider to set the logarithmically compensated bandgap voltage generator to generate, at a second temperature, the logarithmically temperature compensated bandgap voltage equal to the design voltage.

10. A method of generating a voltage logarithmically variable with temperature with a voltage generator comprising first and second bias networks, a differential amplifier comprising first and second transistors, each transistor being respectively coupled to the first and second bias networks and comprising a control terminal, the first and second transistors having a common terminal therebetween, the first and second bias networks respectively biasing in a conduction state the first and second transistors respectively with a constant current and with a proportional to absolute temperature (PTAT) current, the method comprising:

generating between the control terminals of the first and second transistors the voltage logarithmically variable with temperature, and providing a common bias current between the common terminal and a reference potential;

feeding back over a path a current difference between a sum of the constant current and the PTAT current, and the common bias current, the path comprising a third transistor coupled between the common terminal and a supply reference voltage; and controlling the third transistor with a conduction terminal of the first transistor.

11. The method of claim 10 wherein the third transistor comprises a free-wheeling transistor.

12. The method of claim 10 wherein the second transistor comprises a conduction terminal providing an output terminal of the amplifier.

13. The method of claim 12 wherein the conduction terminal of the second transistor is not in common with the first transistor.

* * * * *